US011561065B1

(12) United States Patent
Hoffman et al.

(10) Patent No.: US 11,561,065 B1
(45) Date of Patent: Jan. 24, 2023

(54) HOLSTER BELT FOR CARRYING A HANDGUN HOLSTER

(71) Applicant: VISTA OUTDOOR OPERATIONS LLC, Anoka, MN (US)

(72) Inventors: Justin Hoffman, Elizabeth City, NC (US); Nicholas Alexander Ferros, Virginia Beach, VA (US); Evan R. McNamara, Virginia Beach, VA (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 17/397,867

(22) Filed: Aug. 9, 2021

(51) Int. Cl.
*F41C 33/04* (2006.01)

(52) U.S. Cl.
CPC ..... *F41C 33/046* (2013.01)

(58) Field of Classification Search
CPC .... F41C 33/041; F41C 33/046; F41C 33/048; F41C 33/00; A45F 5/00; A45F 5/02; A45F 5/021; A45F 2003/144; A45F 2200/0591
See application file for complete search history.

(56) References Cited

U.S. PATENT DOCUMENTS

| | | | | |
|---|---|---|---|---|
| 4,579,265 | A | 4/1986 | Schiller | |
| 6,264,081 | B1 * | 7/2001 | Wojciak | B25H 3/00 224/660 |
| 9,581,414 | B1 * | 2/2017 | Mironski | F41C 33/046 |
| 9,891,021 | B2 | 2/2018 | Galoob | |
| 9,945,636 | B2 | 4/2018 | Thompson | |
| 10,631,618 | B2 | 4/2020 | Wasylko | |
| 2006/0237509 | A1 * | 10/2006 | Moore, Sr. | A45F 3/14 224/675 |
| 2012/0061432 | A1 | 3/2012 | Novak | |
| 2015/0366280 | A1 * | 12/2015 | Fay | A41D 27/205 2/248 |
| 2016/0209164 | A1 * | 7/2016 | Fravala | F41C 33/048 |
| 2016/0265875 | A1 * | 9/2016 | Malcolm | F41C 33/048 |
| 2017/0051999 | A1 | 2/2017 | Tedder | |
| 2020/0370864 | A1 | 11/2020 | Cochran | |
| 2021/0025672 | A1 | 1/2021 | Shearer et al. | |
| 2021/0071987 | A1 | 3/2021 | Eberle | |
| 2021/0137252 | A1 * | 5/2021 | Knudsen | B25H 3/00 |

OTHER PUBLICATIONS

"Sport Tuck Belly Band Holster" (Accessed Mar. 19, 2021).
"Selecting a Holster for Your Pack" (Accessed Mar. 19, 2021).
"CrossBreed Holsters Modular Belly Band (Band Only)" (Accessed Mar. 19, 2021).
"ComfortTac Ultimate Belly Band Gun Holster for Concealed Carry" (Accessed Mar. 22, 2021).
"BestBellyBandHolster" (Accessed Mar. 22, 2021).

* cited by examiner

*Primary Examiner* — Corey N Skurdal
(74) *Attorney, Agent, or Firm* — Reed Smith LLP; Matthew P. Frederick; Cheryl L. Gastineau

(57) ABSTRACT

A holster belt is configured to support a holster and a handgun combination. The holster belt has a belt portion defining an inner layer and an outer layer comprising an elastic material. The holster belt further has a closure and a holster engagement strip, wherein the holster engagement strip is rigid and is configured to support a holster and a handgun combination, wherein the holster comprises a holster body configured for receiving the handgun and a belt clip, wherein the holster engagement strip is configured to be sized for engagement with the belt clip of the holster.

20 Claims, 8 Drawing Sheets

HOLSTER BELT FOR CARRYING A HANDGUN HOLSTER

FIELD

Exemplary embodiments disclosed herein relate to holster belts for carrying a handgun holster.

BACKGROUND

Many users of handguns carry a handgun in a holster designed to protect the handgun and hold it securely. When the handgun is to be used, the user may withdraw the handgun from the holster, and then return it to the holster when finished. Holsters can be worn in a number of ways such as on a belt at the waist, on the thigh, under an arm, or around an ankle. In some cases, the holster may allow the user to conceal the handgun, or to conceal the fact that the user is carrying the handgun.

In some situations, the user may desire to carry the handgun while wearing clothing that doesn't lend itself to the use of a belt, such as athletic clothing, a skirt or dress, or like apparel.

SUMMARY

In embodiments, a belt comprises a belt portion defining an upper edge, a lower edge, a first end, a second end, an inner face and an outer face, wherein the belt portion further comprises an inner layer comprising an elastic material and defining an upper edge, a lower edge, an inner face and an outer face of the inner layer; and an outer layer comprising an elastic material and defining an upper edge, a lower edge, an inner face and an outer face of the outer layer, wherein the lower edges of the inner and outer layers of the belt portion are secured together; and a closure disposed on at least one of the first end and the second end, wherein the closure is arranged to couple together the first end and the second end; and In embodiments, a holster engagement strip defines a first end, a second end, an upper edge, a lower edge, an inner face, an outer face, wherein the holster engagement strip is rigid and is configured to support a holster and a handgun combination, wherein the holster comprises a holster body configured for receiving the handgun and a belt clip, wherein the holster engagement strip is configured to be sized for engagement with the belt clip of the holster; wherein the holster engagement strip is secured to the outer face of the belt portion at spaced apart first and second securement seams; wherein a portion of the holster engagement strip between the first and second securement seams defines a holster mounting portion configured to mount a holster between the belt portion and the holster mounting portion; and wherein holster engagement strip is disposed between the upper and lower edges of the belt portion such that the upper edge of the holster engagement strip is spaced from the upper edge of the belt portion and the lower edge of the holster engagement strip is spaced form the lower edge of the belt portion, wherein the holster mounting portion is free from securement to the belt portion between the first and second seams.

In certain embodiments, the holster engagement strip further comprise an inner layer comprising a nylon belt webbing material; and an outer layer comprising a nylon belt webbing material.

In certain embodiments, the inner layer and outer layer of the holster engagement strip in the holster mounting portion are secured to one another.

In certain embodiments, the holster engagement strip comprises a width of about 1.5 inches.

In certain embodiments, the holster engagement strip comprises a nylon webbing material having a rigidity sufficient to support the holster and handgun combination.

In certain embodiments, the holster engagement strip comprises a scuba webbing material.

In certain embodiments, the inner layer and outer layer of the belt portion are secured to each other at the first and second vertical securement seams.

In certain embodiments, the inner layer and outer layer of the belt portion are secured to each other at third and fourth vertical securement seams, wherein the third securement seam is spaced from the first securement seam towards the first end of the belt portion, and the fourth securement seam is spaced from the fourth securement seam towards the second end of the belt portion.

In certain embodiments, a first pocket is formed between the first and second layers of the belt portion between the first and third securement seams, and a second pocket is formed between the first and second layers of the belt portion between the second and fourth securement seams.

In certain embodiments, the first end of the holster engagement strip extends into the first pocket, and the second end of the holster engagement strip extends into the second pocket, wherein the holster engagement strip is configured to impart rigidity to the first pocket and second pockets, and wherein each of the first and second pockets is configured to hold a magazine.

In certain embodiments, the inner layer and outer layer of the belt portion are further secured to each other at fifth and sixth vertical securement seams, wherein the fifth securement seam is spaced from the third securement seam towards the first end of the belt portion, and the sixth securement is spaced from the fourth securement seam towards the second end of the belt portion.

In certain embodiments, a third pocket is formed between the first and second layers of the belt portion between the third and fifth securement seams, and a fourth pocket is formed between the first and second layers of the belt portion between the fourth and sixth securement seams, wherein each of the third and fourth pockets is configured to hold an accessory.

In certain embodiments, the inner layer further comprises a layer of cushioning material extending between the third and fourth vertical securement seams.

In certain embodiments, the layer of cushioning material is configured to limit the stretching of the elastic material of the inner layer between the third and fourth vertical securement seams, wherein the inner layer is configured as a leaf spring between the first and second vertical securement seams.

In certain embodiments, the closure comprises hook and loop material.

In certain embodiments, a holster belt has a belt portion; a closure disposed on at least one of a first end and a second end of the belt portion, wherein the closure is arranged to couple together the first end and the second end; and a holster engagement strip located substantially in the middle of the belt portion comprising a nylon webbing material having a rigidity sufficient to support a holster and a handgun combination, wherein the holster comprises a holster body configured for receiving the handgun and the belt clip, the holster engagement strip having a width of about 1.5 inches; a first and a second vertical securement seam, wherein the holster engagement strip is secured to an outer face of the belt portion at the first and the second vertical securement seam, wherein the holster mounting portion is free from securement to the belt portion between the first and second seams, and wherein the first and second securement seams are spaced apart at a width configured to accommodate a holster and handgun combination in between the holster engagement strip and the outer face of the belt portion when the belt clip is secured to the holster engagement strip, the holster belt further configured to accept a right-handed or left-handed IWB holster when the belt clip is secured to the holster engagement strip.

In certain embodiments, a first pocket and a second pocket are integrally formed in the belt portion on either side of the first and second vertical securement seam.

In certain embodiments, a third pocket and a fourth pocket are integrally formed in the belt portion on either side of the first and second pocket away from the holster engagement strip.

In certain embodiments, the holster engagement strip further has an inner layer comprising a nylon belt webbing material; and an outer layer comprising a nylon belt webbing material, wherein the inner layer and outer layer of the holster engagement strip in the holster mounting portion are secured to one another.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
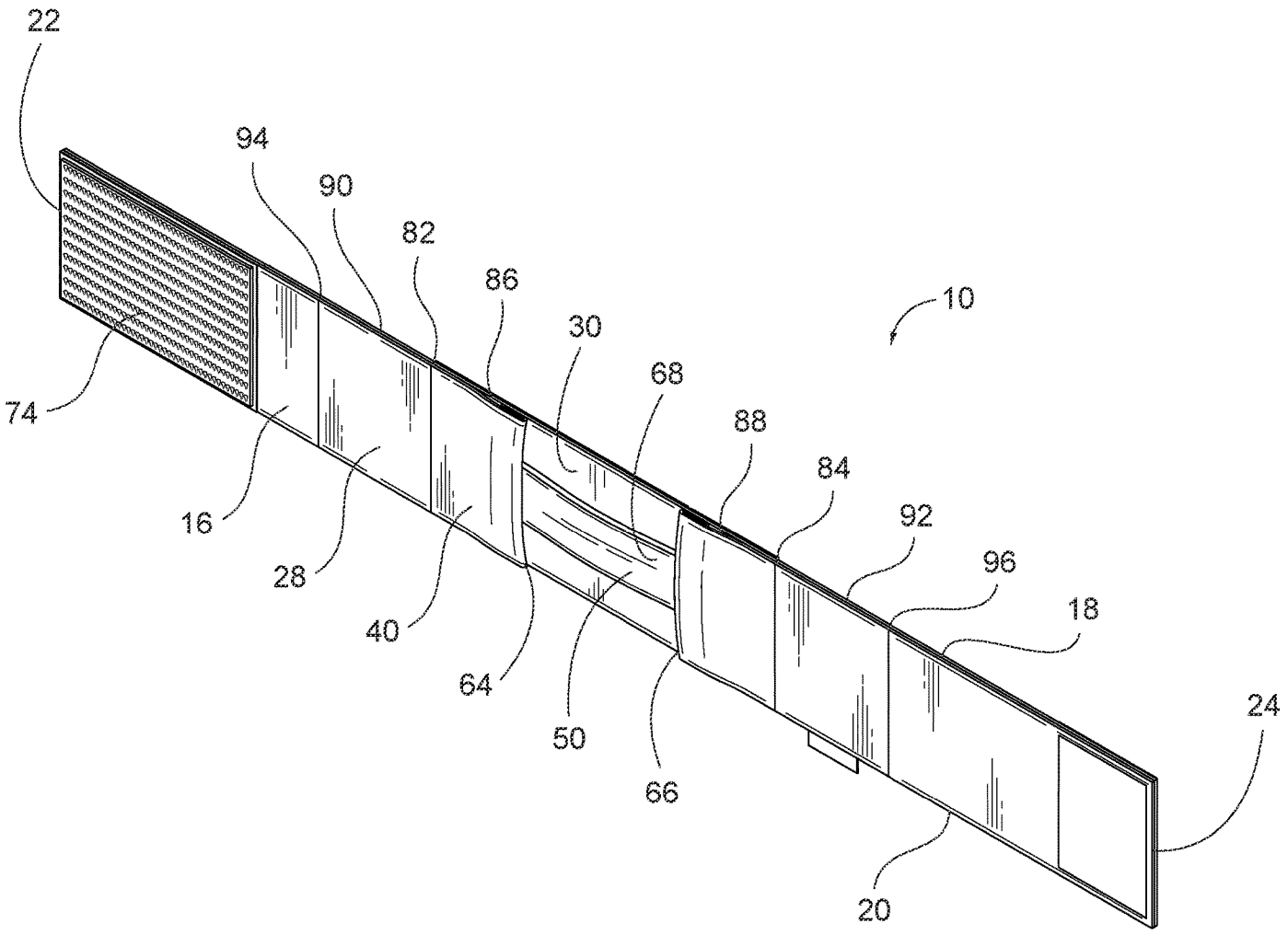
FIG. 1 is a top, front perspective view of the holster belt according to an exemplary embodiment.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

FIGS. 1-11 provide examples of embodiments of holster belts for carrying a holster. Elements that serve a similar, or at least substantially similar, purpose are labelled with like numbers in each of FIGS. 1-11, and these elements may not be discussed in detail herein with reference to each of FIGS. 1-11, but reference numbers associated therewith may be utilized herein for consistency. Elements, components, and/or features that are discussed herein with reference to one or more of FIGS. 1-11 may be included in and/or utilized with any of FIGS. 1-11 without departing from the scope of the present disclosure.

With reference to FIGS. 1-11, certain embodiments may include a holster belt 10 for carrying a handgun holster 12 supporting a handgun 14. For example, holster belt 10 may be a belly band, sport or active style belt configured to be worn about the waist or hips of a user and sized to carry a handgun holster 12 and handgun combination as well as other items and accessories while providing ready access to the handgun 14.

In embodiments, holster belt 10 has a belt portion 16 defining an upper edge 18, a lower edge 20, a first end 22, a second end 24, an inner face 26 and an outer face 28. The belt portion 16 further comprises an inner layer 30 comprising an elastic material and defining an upper edge 32, a lower edge 34, an inner face 36 and an outer face 38 of the inner layer 30. In certain embodiments, belt portion 16 may have rounded corners (FIG. 11) which are configured to provide comfort.

In embodiments, an outer layer 40 comprises an elastic material and defines an upper edge 42, a lower edge 44, an inner face 46 and an outer face 48 of the outer layer 40. The lower edges 34, 44 of the inner and outer layers 30, 40 of the belt portion 16 are secured together. In certain embodiments, the elastic material of the inner and outer layers, 30, 40 is configured to stretch in the horizontal direction and not in the vertical direction such that the elastic material provides a comfortable fit about a user's waist. Elements of the holster belt 10 may be secured together by stitching, adhesives, staples, ultrasonic welding, etc. In certain embodiments, the vertical width of the inner and outer layers, 30, 40 is about 4 inches.

In certain embodiments, a holster engagement strip 50 defines a first end 52, a second end 54, an upper edge 56, a lower edge 58, an inner face 60, an outer face 62 wherein the holster engagement strip 50 is rigid and is configured to support the handgun 14 and a holster 12 combination without bending or sagging. The holster 12 comprises a belt clip 12*a* and a holster body 12*b* configured for receiving the handgun 14. The holster engagement strip 50 is configured to be sized for engagement with the belt clip 12*a* of the holster 12.

In embodiments, the holster engagement strip 50 is secured to the outer face 28 of the belt portion 16 at first and second vertical securement seams 64, 66. A portion of the holster engagement strip 50 between the first and second securement seams 64, 66 defines a holster mounting portion 68 configured to mount the holster 12 between the belt portion 16 and the holster mounting portion 68. The holster mounting portion 68 is free from securement to the belt portion 16 between the first and second vertical securement seams 64, 66. In this way, the holster mounting portion 68 is able to accommodate a belt clip 12*a* of a holster 12 in the same manner as a belt, for example, worn on the pants of a user. In certain embodiments, the first and second vertical securement seams 64, 66 defining the holster mounting portion 86 are spaced apart about 4.75 inches which is a sufficient width allowing a holster 12 to be inserted between the belt portion 16 and the holster mounting portion 68, wherein such holster is configured to accommodate a midsize pistol, for example a Glock19. In certain embodiments, the holster engagement strip 50 is secured to the outer face 28 of the belt portion 16 at the first and the second vertical securement seams 64, 66, wherein the first and second securement seams 64, 66 are spaced apart at a width configured to accommodate a holster 12 and handgun 14 combination in between the holster engagement strip 50 and the outer face 28 of the belt portion when the belt clip 12*a* is secured to the holster engagement strip 50. In certain embodiments, the holster belt 10 is configured to accept a right-handed or left-handed IWB holster when the belt clip 12*a* is secured to the holster engagement strip 50. In other embodiments, holster bel 10 has a first pocket 86 and a second pocket 88 integrally formed in the belt portion 16 on either side of the first and second vertical securement seams 64, 66. In embodiments, a third pocket 90 and a fourth pocket 92 are integrally formed in the belt portion 16 on either side of the first and second pockets 86, 88 away from the holster engagement strip 50. In certain embodiments, the inner layer 30 of the belt portion 16 between the first and second vertical securement seams 64, 66 provides a sufficient biasing force against a holster 12 inserted between the inner layer 30 and the holster mounting portion 68 of the holster engagement strip 50. In certain embodiments, the combination of the inner layer 30 and holster mounting portion 68 between the first and second vertical securement seams 64, 66 is configured as a leaf spring providing a lateral biasing force pressing against holster 12. In other embodiments, inner layer 30 is more compliant than holster mounting portion 68, such that inner layer 30 deflects more than holster mounting portion 68 when a holster 12 is inserted between inner layer 30 and holster mounting portion 68 and secured by a belt clip 12*a*. In certain embodiments, the holster engagement portion is about 4.75 inches between the first and second vertical securement seams 64, 66. In further embodiments, the holster mounting portion is generally horizontal, or parallel with holster belt 10.

In certain embodiments, a holster 12 includes a holster body 12*b* to secure the handgun 14, and includes the belt clip 12*a* secured to the outside of the holster body 12*b*. The belt clip 12*a* is attached to the holster body 12*b* such that when the holster 12 is mounted in a traditional manner to a user's belt, worn on the pants of a user, either outside-the-waistband (OWB) or inside-the-waistband (IWB), that the handgun 14 is oriented in a generally vertical orientation with respect to the axis of the handgun barrel. As used herein, this will be referred to as a belt clip 12*a* having a vertical position. Some handgun holsters 12 have adjustable belt clips 12*a* that allow a user to adjust the cant, or angle, of the holster 12 when mounted to a user's belt via the belt clip in either IWB or OWB configuration. Typically, the cant is adjust able from 0 degrees (vertical) to +/−45 degrees.

In certain embodiments, the holster belt 10 includes a holster engagement strip 50 that is configured such that when either a right-handed holster or a left-handed holster is mounted on the holster engagement strip 50 via the belt clip 12*a*, the holster 12 maintains a substantially vertical cant for a belt clip 12*a* in the vertical position. In other embodiments, a holster engagement strip 50 that is configured such that when either a right-handed holster or a left-handed holster is mounted on the holster engagement strip 50 via the belt clip 12*a*, the holster 12 maintains a cant of up to +/−20 degrees for a belt clip 12*a* in the vertical position. In other embodiments, the holster engagement strip 50 is configured such that when either a right-handed holster or a left-handed holster is mounted on the holster engagement strip via the belt clip 12*a*, the holster maintains a cant of up to +/−45 degrees for a holster 12 having a belt clip 12*a* that is oriented in the vertical position. For embodiments where the cant of the holster is greater or less than zero for a holster 12 having a belt clip 12*a* that is oriented in the vertical position, the holster mounting portion is mounted at a corresponding angle from horizontal.

In other words, a belt clip 12*a* and holster 12 are able to completely enclose the holster mounting portion 68, like a belt clip 12*a* would if it mounted to a belt worn on the pants of a user. Because the belt clip 12*a* of a holster 12 can mount securely to the holster mounting portion 12*a*, when mounted, the holster 12 is retained between the holster mounting portion 68 and inner layer 30 of the belt portion 16. This allows the holster belt 10 to accommodate a standard IWB holster when mounted in between the holster mounting portion 68 and inner layer 30 of the belt portion 16, or optionally OWB holster when mounted on the outside of the holster mounting portion, in both left-handed and right-handed configurations.

In certain embodiments the outer layer 40 of the belt portion 16 is discontinuous between the first and second vertical securement seams 64, 66 forming separate first and second outer layer portions 40*a*, 40*b*.

In certain embodiments, the holster engagement strip 50 is disposed between the upper and lower edges 18, 20 of the belt portion 16 such that the upper edge 56 of the holster engagement strip 50 is spaced from the upper edge 18 of the belt portion 16, and the lower edge 58 of the holster engagement strip 50 is spaced form the lower edge 20 of the belt portion 16. In other embodiments, the holster engagement strip 50 is generally in the middle of the belt portion 16 in at least one of horizontal and vertical positions. In other embodiments, holster engagement strip 50 is generally horizontal, and parallel with holster belt 10.

Holster engagement strip 50 may comprise a rigid nylon webbing material such as scuba webbing material. This nylon webbing material is fabric woven into a belt shape. In embodiments, the nylon webbing material is sufficiently rigid such that it is capable of securely supporting a holster 12 and handgun 14 without sagging or buckling. In embodiments, "sufficiently rigid" is defined as the holster engagement strip 50 being difficult to compress or buckle under the pressure of a user's hand squeezing the holster engagement strip 50 from the upper and lower edges 56, 58. Holster engagement strip 50 has a width sufficient to engage with a holster clip 12*a* of a holster. In certain embodiments, the holster engagement strip 50 has a width of from about 1.5 to about 1.75 inches. In other embodiments, the holster engagement strip has a width of about 1.5 inches and a thickness of about 0.2 inches to 0.25 inches. In certain embodiments, holster engagement strip 50 may be constructed from fabric, extruded plastic, metal, etc.

In certain embodiments, the holster engagement strip 50 may be a single layer of rigid webbing material. In certain embodiments, holster engagement strip 50 may be two or more layers such as an inner layer 70; and an outer layer 72 of sufficiently rigid material. In certain embodiments, the inner layer 70 and outer layer 72 of the holster engagement strip 50 in the holster mounting portion 68 are secured to one another and provide additionally rigidity. In those embodiments, the layers may be sewn together, or secured to one another by, for example, adhesive, ultrasonic welding, clips, etc. In certain embodiments, the thickness of the double layer of the inner layer 70 and the outer layer 72 is about 0.2 inches to 0.25 inches.

Figure 2:
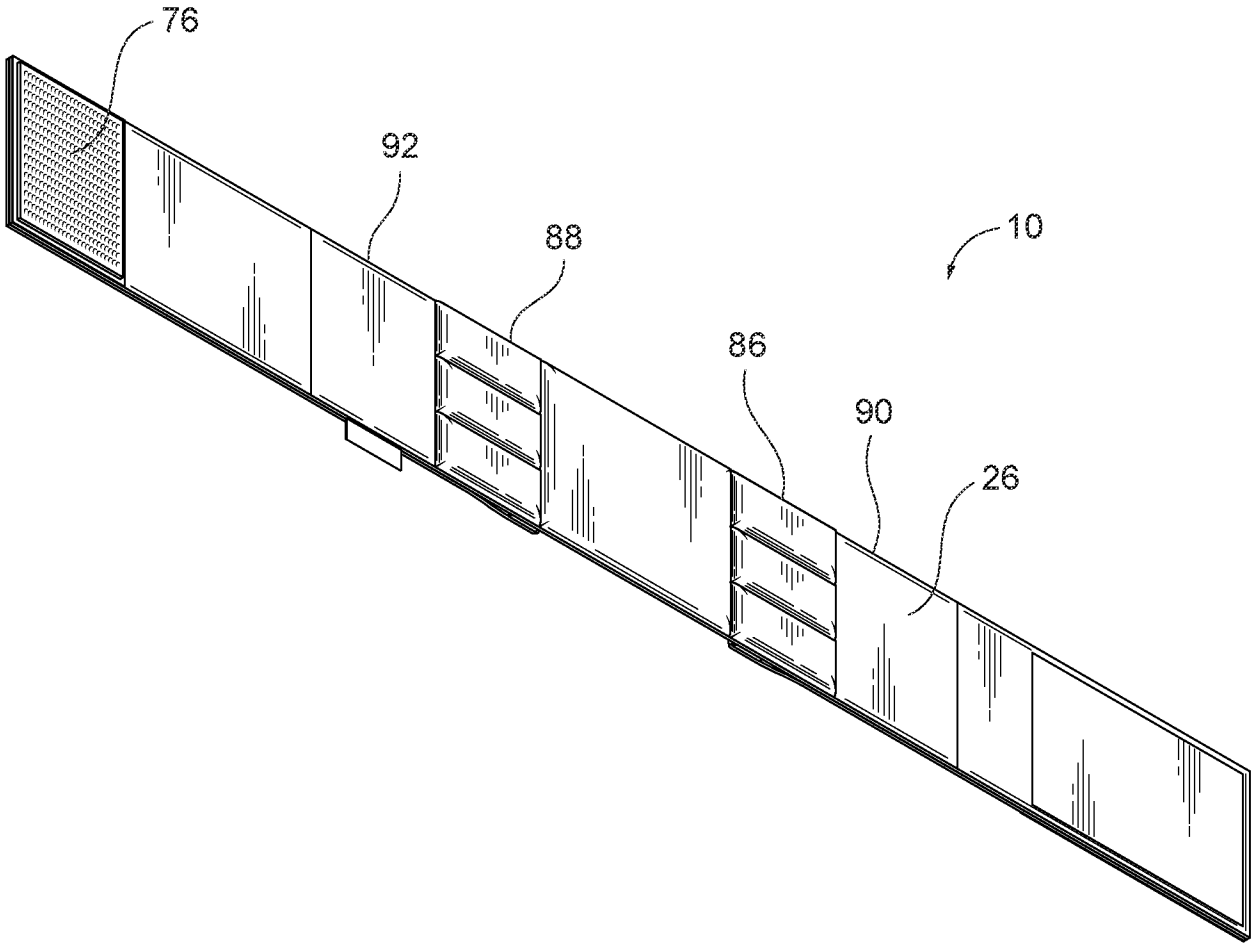
FIG. 2 is a bottom, rear perspective view of the holster belt of FIG. 1.
Figure 3:
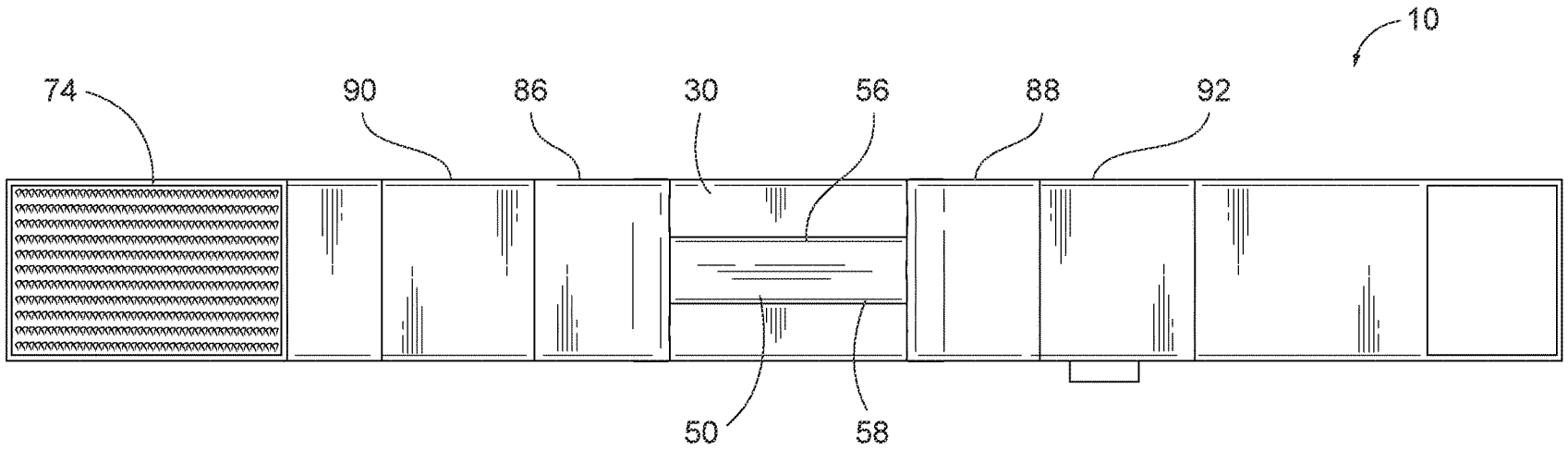
FIG. 3 is a front view of the holster belt of FIG. 1.
Figure 4:
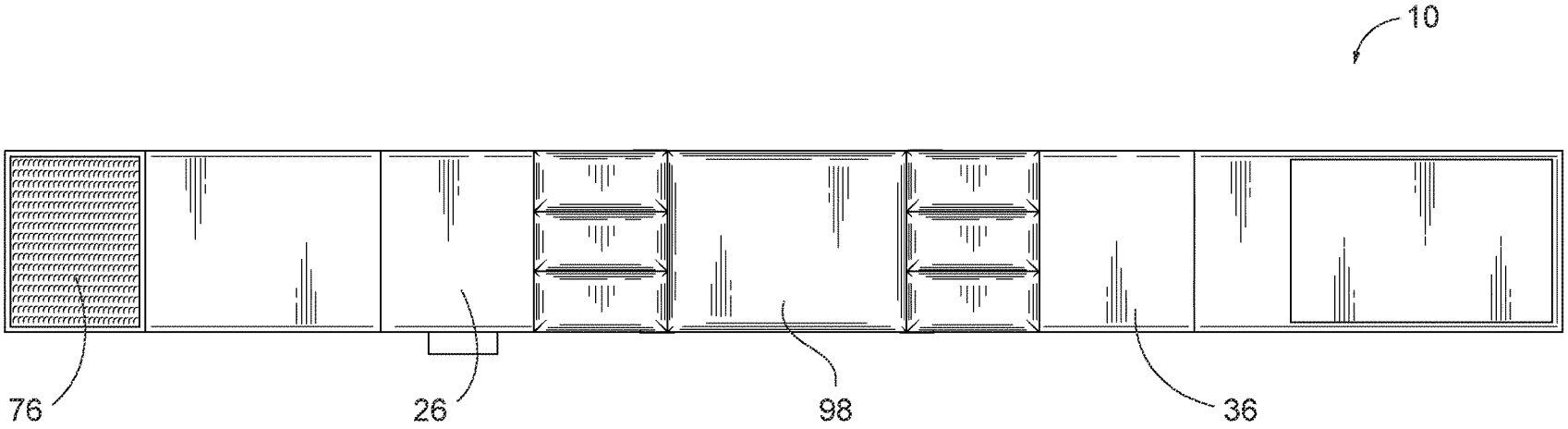
FIG. 4 is a rear view of the holster belt of FIG. 1.
Figure 5:
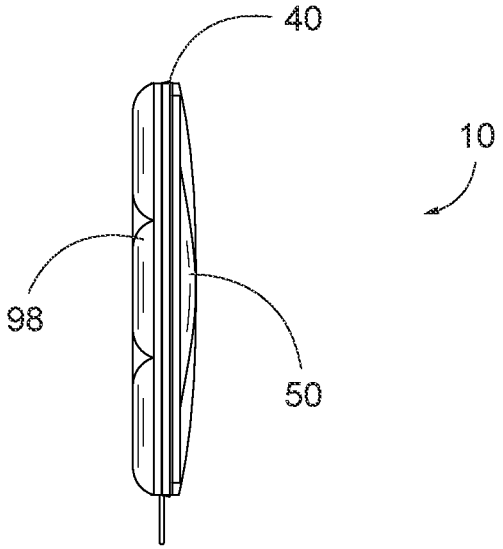
FIG. 5 is a right side view of the holster belt of FIG. 1.
Figure 6:
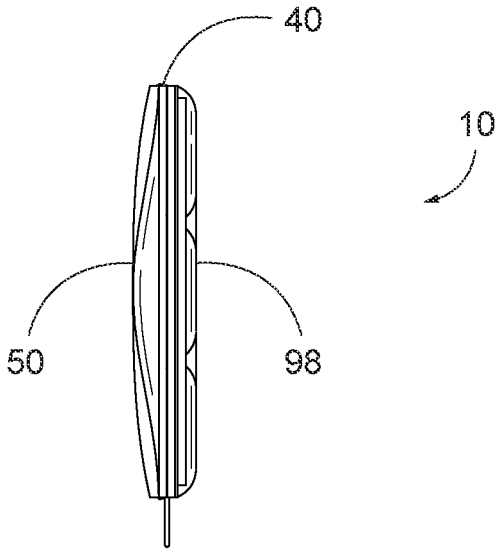
FIG. 6 is a left side view of the holster belt of FIG. 1.
Figure 7:
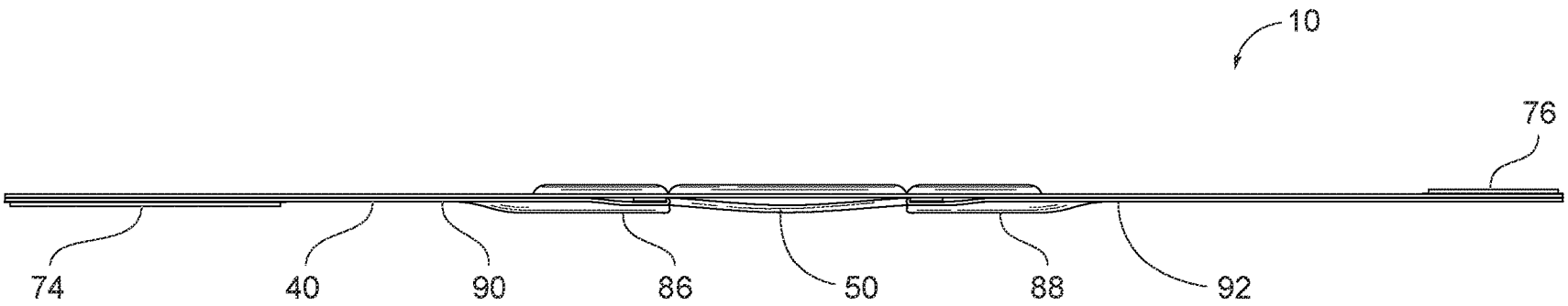
FIG. 7 is a top view of the holster belt of FIG. 1.
Figure 8:
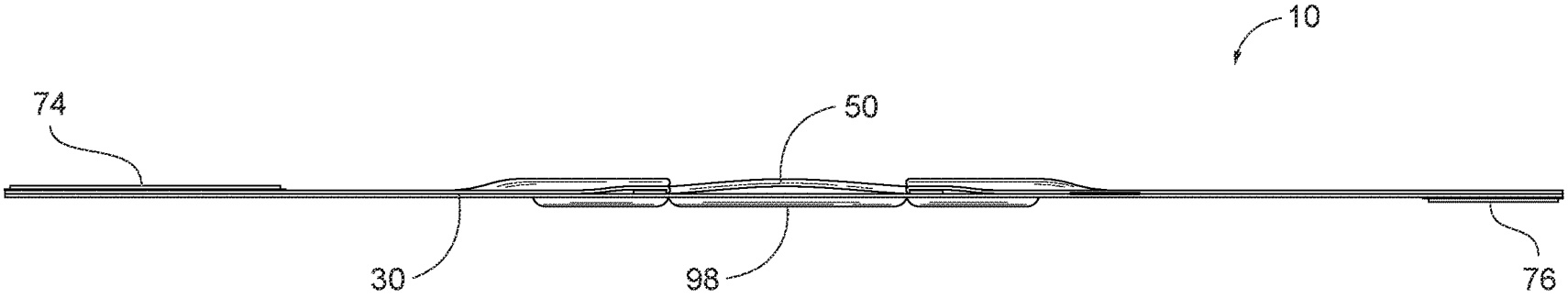
FIG. 8 is a bottom view of the holster belt of FIG. 1.
Figure 9:
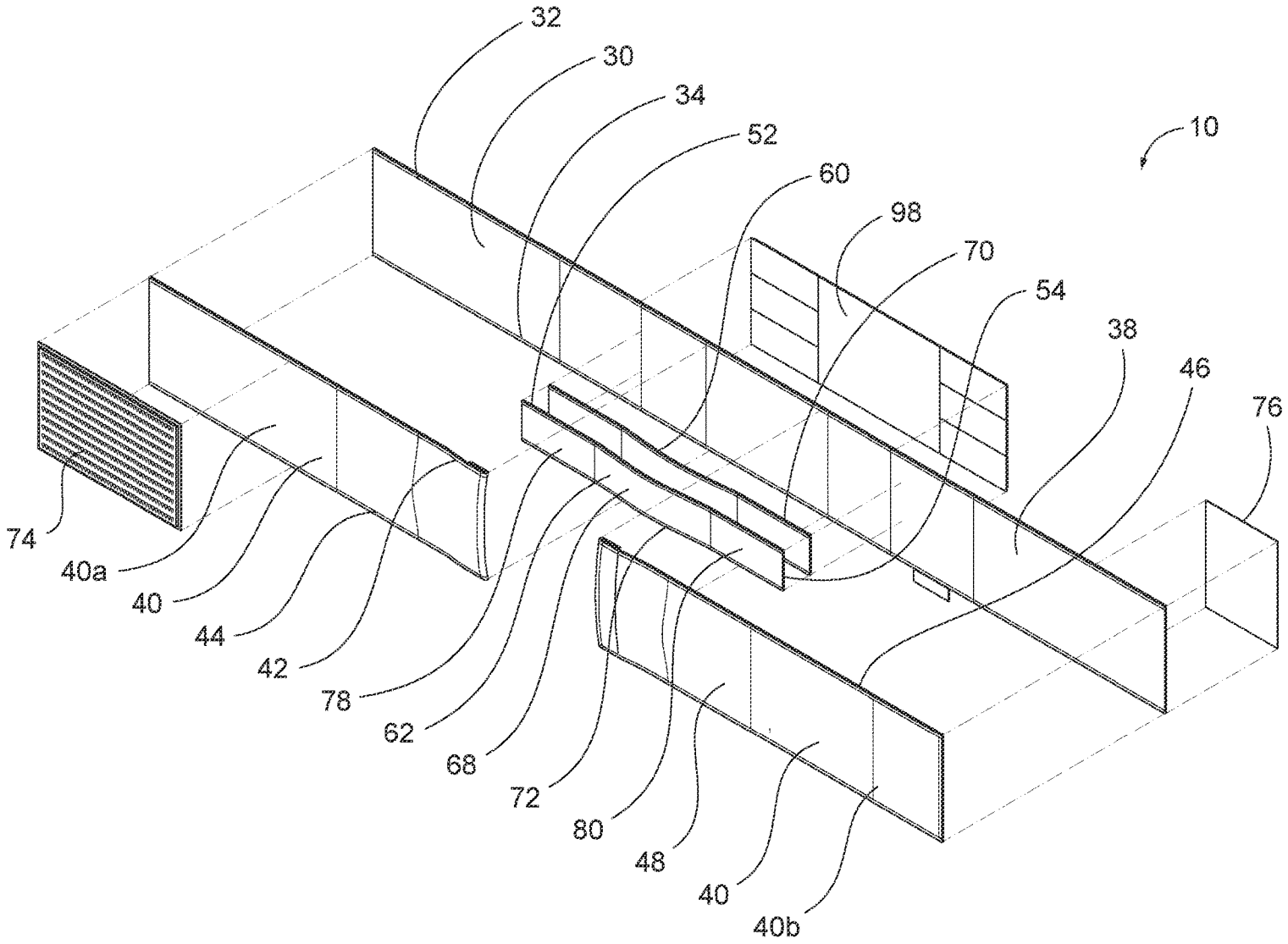
FIG. 9 is exploded view of the holster belt of FIG. 1.
Figure 10:
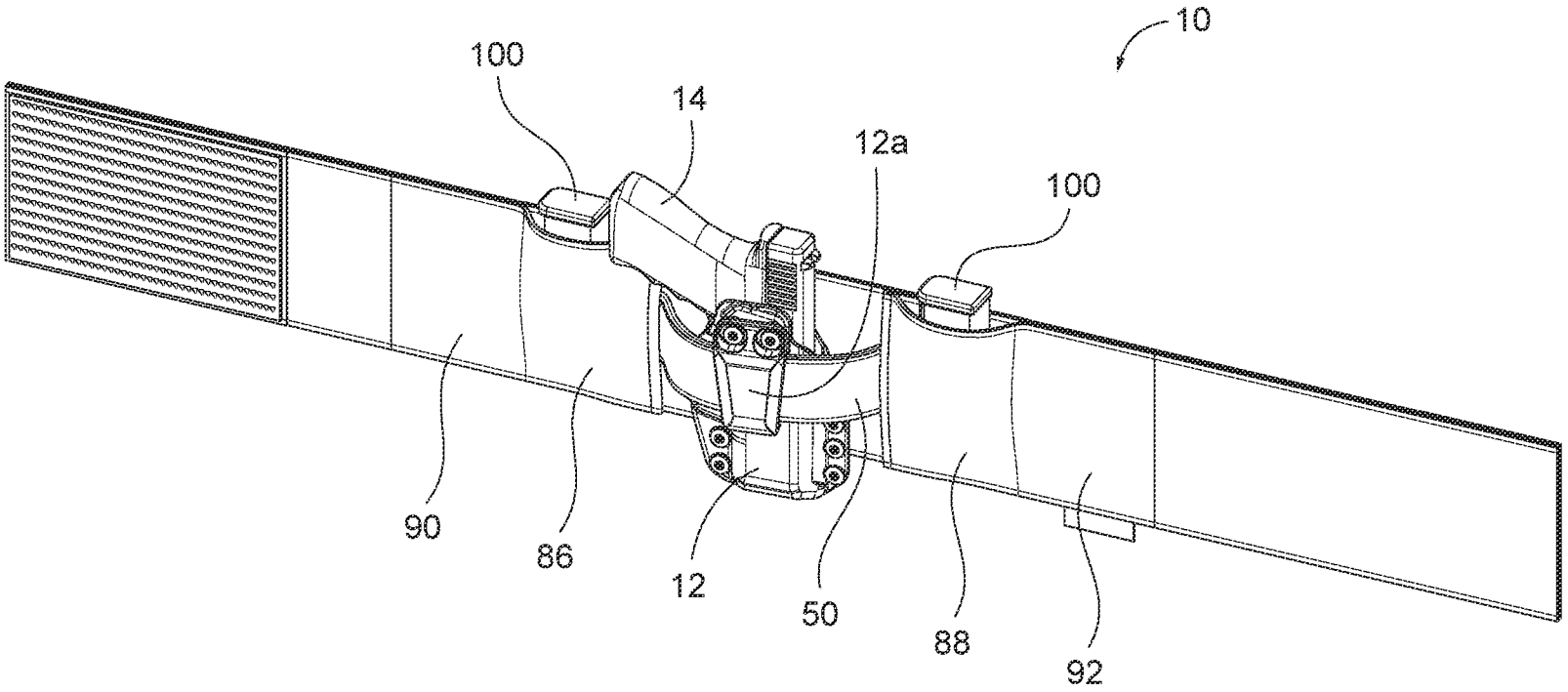
FIG. 10 is a top, front perspective view of the holster belt of FIG. 1 supporting a right-handed holster.
Figure 11:
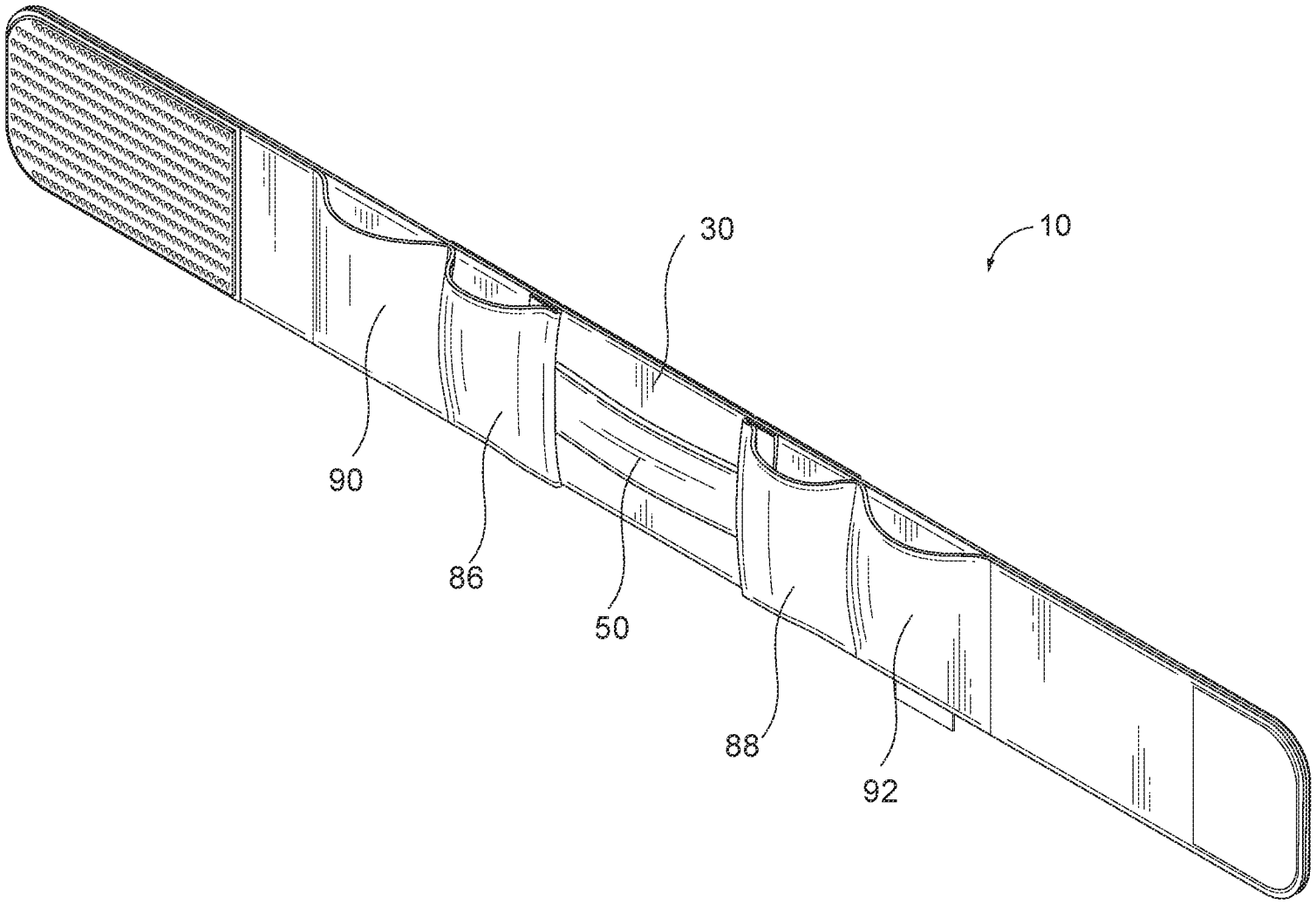
FIG. 11 is a perspective view of an embodiment of the holster belt having rounded corners.

In certain embodiments, a first closure 74 is disposed on at least one of the first end 22 and the second end 24 of the belt portion 16, wherein the first closure 74 is arranged to couple together the first end 22 and the second end 24. In certain embodiments, a second closure 76 is on the other of the first end 22 and the second end 24 and is configured to couple together with the first closure 74. In certain embodiments, as shown in FIGS. 1-2, first and second closures 74, 76 may be hook and loop material, such that hook material is on the outer face 28 of the belt portion 16 at one of the first and second ends 22, 24, and loop material is on the inner face 26 of the belt portion 16 at the other of the first and second ends 22, 24. In other embodiments, the orientation and location of the hook and loop material may be reversed. In certain embodiments, first and second closures 74, 76 may be other types of closures such as snaps, straps, hooks, clasps, magnets, zippers, buckles, adhesives, etc.

In certain embodiments, the holster engagement strip 50 further has first and second pocket support portions 78, 80 each disposed between the mounting portion first and second securement seams 64, 66 and the respective first and second ends 52, 54 of the holster engagement strip 50. In certain embodiments, pocket support portions 78, 80 are disposed between the inner and outer layers 30, 40 of the belt portion 16 and secured to the inner layer 30 providing rigidity to the inner layer 30. In certain embodiments, pocket support portions 78, 80 are secured to the inner layer 30 by box stitching the pocket support portions 78, 80 to the inner layer 30.

In certain embodiments, there are third and fourth vertical securement seams 82, 84 spaced outwardly about 2.75 inches from the first and second vertical securement seams securing the inner layer and outer layer 30, 40 of the belt portion 16 and the first and second ends 52, 54 of the holster engagement strip 50. In certain embodiments, the pocket support portions 78, 80 terminate at the third and fourth vertical securement seams 82, 84. In certain embodiments there are fifth and sixth vertical securement seams 94, 96 spaced outwardly about 3.5 inches from the third and fourth vertical securement seams 82, 84, wherein the fifth and sixth vertical securement seams 94, 96 secure the inner layer and outer layer 30, 40 of the belt portion 16.

In certain embodiments, the first pocket 86 is formed between the inner and outer layers 30, 40 of the belt portion 16 between the first and third vertical securement seams 64, 82, and the second pocket 88 is formed between the first and second layers 30, 40 of the belt portion 16 between the second and fourth securement seams 66, 92. In certain embodiments, pocket support portions 78, 80 of the holster engagement strip 50 extend into the first and second pockets 86, 88 to impart rigidity to the respective pockets, such that the first and second pockets 86, 88 are configured to hold an accessory such as a handgun magazine 100.

In certain embodiments, the third pocket 90 is formed between the inner and outer layers 30, 40 of the belt portion 16 between the third and fifth vertical securement seams 82, 94, and the fourth pocket 92 is formed between the first and second layers 30, 40 of the belt portion 16 between the fourth and sixth securement seams 92, 96. In certain embodiments, the third and fourth pockets 90, 92 are configured to hold an accessory. For example the accessory may include additional handgun magazines, pepper spray, a wallet, a mobile phone, keys, a knife, etc.

In certain embodiments, the first and second layers 30, 40 of the belt portion 16 of the first, second, third and fourth pockets 86, 88, 90, 92 are secured at the lower edges 34, 44 of the first and second layers 30, 40, and are free from securement at the upper edges 32, 42 the first and second layers 30, 40 of the belt portion 16, and are bound on either side by the vertical securement seams 64, 82, 94 and 66, 84, 96.

In certain embodiments, the inner layer 30 also includes a layer of cushioning material 98 extending between the third and fourth vertical securement seams 82, 84 which provides cushioning, additional rigidity and stability to inner layer 30 between the third and fifth vertical securement seams 82, 94, and also limits the stretching of the elastic material of the inner layer 30 between the third and fourth vertical securement seams 82, 84 such that the elastic material of the inner layer 30 in combination with the holster engagement strip 50 acts as a leaf spring providing a lateral biasing force pressing the holster 12 between the inner layer 30 and the holster mounting portion 68 of the holster engagement strip 50.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be omitted or replaced by alternative features serving the same, equivalent or similar purpose, unless expressly stated otherwise. Certain features may sometimes be used to advantage without a corresponding use of other features. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This disclosure is intended to cover adaptations or variations of the present subject matter. Applicants intend to embrace all such alternatives, modifications, equivalents, and variations that are within the spirit and scope of the exemplary embodiments. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A holster belt configured to support a holster and hangun combination when in use of the holster belt, wherein the holster includes a holster body and a belt clip, the holster belt comprising:

a belt portion defining an upper edge, a lower edge, a first end, a second end, an inner face and an outer face, wherein the belt portion further comprises:

an inner layer comprising an elastic material and defining an upper edge, a lower edge, an inner face and an outer face of the inner layer; and an outer layer comprising an elastic material and defining an upper edge, a lower edge, an inner face and an outer face of the outer layer, wherein the lower edges of the inner and outer layers of the belt portion are secured together;

a closure disposed on at least one of the first end and the second end, wherein the closure is arranged to couple together the first end and the second end; and a holster engagement strip defining a first end, a second end, an upper edge, a lower edge, an inner face, an outer face, wherein the holster engagement strip comprises a nylon webbing material configured to have a rigidity sufficient to support the holster and handgun combination when the holster and handgun combination is supported by the holster belt, wherein the holster engagement strip is configured to be sized for engagement with the belt clip of the holster when the holster and handgun combination is supported by the holster belt;

a first vertical securement seam and a second vertical securement seam, wherein the holster engagement strip is secured to the outer face of the belt portion at the first and the second vertical securement seam, wherein the first and second securement seams are spaced apart at a width configured to accommodate the holster and handgun combination in between the holster engagement strip and the outer face of the belt portion when the holster and handgun combination is supported by the holster belt and the belt clip is secured to the holster engagement strip;

wherein a portion of the holster engagement strip between the first and second securement seams defines a holster mounting portion configured to mount the holster between the belt portion and the holster mounting portion when the holster and handgun combination is supported by the holster belt;

wherein the holster engagement strip is disposed between the upper and lower edges of the belt portion such that the holster engagement strip is substantially in a middle of the belt portion and substantially horizontally oriented, wherein the holster mounting portion is free from securement to the belt portion between the first and second seams;

wherein the inner layer and outer layers of the belt portion are secured to each other at the first and second vertical securement seams;

a third vertical securement seam and a fourth vertical securement seam, wherein the inner layer and outer layer of the belt portion are secured to each other at the third and the fourth vertical securement seam, wherein the third vertical securement seam is spaced from the first vertical securement seam towards the first end of the belt portion, and the fourth vertical securement seam is spaced from the fourth vertical securement seam towards the second end of the belt portion; and a first pocket is formed between the inner and outer layers of the belt portion between the first and third vertical securement seams, and a second pocket is formed between the inner and outer layers of the belt portion between the second and fourth vertical securement seams.

2. The holster belt of claim 1, wherein the holster engagement strip further comprises:

an inner layer comprising a nylon belt webbing material; and an outer layer comprising a nylon belt webbing material.

3. The holster belt of claim 2, wherein the inner layer and outer layer of the holster engagement strip in the holster mounting portion are secured to one another.

4. The holster belt of claim 1, wherein the holster engagement strip comprises a width of about 1.5 inches.

5. The holster belt of claim 1, wherein the elastic material of the inner and outer layers is configured to stretch in the horizontal direction and not in the vertical direction.

6. The holster belt of claim 1, wherein the holster engagement strip comprises a scuba webbing material.

7. The holster belt of claim 1, wherein the outer layer of the belt portion is discontinuous between the first and second securement seams and configured as separate first and second outer layer portions.

8. The holster belt of claim 1, wherein the holster engagement strip further comprises first and second pocket support portions each between the first and second vertical securement seams and the first and second ends of the holster engagement strip, wherein the first and second pocket support portions are each disposed with the respective first and second pockets, wherein the first and second pocket support portions are configured to impart rigidity to the first pocket and second pockets, and wherein each of the first and second pockets is configured to hold a magazine.

9. The holster belt of claim 8, wherein the inner layer and outer layer of the belt portion are further secured to each other at a fifth and a sixth vertical securement seam, wherein the fifth securement seam is spaced from the third securement seam towards the first end of the belt portion, and the sixth securement is spaced from the fourth securement seam towards the second end of the belt portion.

10. The holster belt of claim 9, wherein a third pocket is formed between the inner and outer layers of the belt portion between the third and fifth securement seams, and a fourth pocket is formed between the inner and outer layers of the belt portion between the fourth and sixth securement seams, wherein each of the third and fourth pockets is configured to hold an accessory.

11. The holster belt of claim 10, wherein the inner layer further comprises a layer of cushioning material extending between the third vertical securement seam and fourth vertical securement seams.

12. The holster belt of claim 11, wherein the layer of cushioning material is configured to limit the stretching of the elastic material of the inner layer between the third and fourth vertical securement seams, wherein the combination of the inner layer and the holster engagement strip is configured as a leaf spring between the first and second vertical securement seams.

13. The holster belt of claim 1, wherein the elastic material of the inner layer and the outer layer is stretchable in the horizontal direction between the third and fourth vertical securement seams and the respective first and second ends of the belt portion.

14. The holster belt of claim 1, wherein the closure comprises hook and loop material.

15. The holster belt of claim 14, wherein hook material is disposed on the outer face of the belt portion at one of the first and second ends of the belt portion, and loop material is disposed on the inner face of the belt portion at the other of the first and second ends of the belt portion.

16. The holster belt of claim 1, wherein the holster engagement strip is horizontal.

17. The holster belt of claim 1, wherein the holster engagement strip is canted at an angle of 30 degrees or less.

18. A holster belt configured to support a holster and hangun combination when in use of the holster belt, wherein the holster includes a holster body and a belt clip, the holster belt comprising:

a belt portion;

a closure disposed on at least one of a first end and a second end of the belt portion, wherein the closure is arranged to couple together the first end and the second end; and a holster engagement strip located substantially in a middle of the belt portion and substantially horizontally oriented, the holster engagement strip comprising a nylon webbing material configured to have a rigidity sufficient to support the holster and handgun combination when the holster and handgun combination is supported by the holster belt, the holster engagement strip having a width of about 1.5 inches;

a first vertical securement seam and a second vertical securement seam, wherein the holster engagement strip is secured to an outer face of the belt portion at the first and the second vertical securement seam, a portion of the holster engagement strip between the first and second securement seams defines a holster mounting portion, wherein the holster mounting portion is free from securement to the belt portion between the first and second seams, and wherein the first and second securement seams are spaced apart at a width configured to accommodate a holster and handgun combination in between the holster engagement strip and the outer face of the belt portion when the holster and handgun combination is supported by the holster belt and the belt clip is secured to the holster engagement strip, the holster belt further configured to accept a right-handed or left-handed IWB holster when the holster and handgun combination is supported by the holster belt and the belt clip is secured to the holster engagement strip; and a first pocket and a second pocket integrally formed in the belt portion on either side of the first and second vertical securement seam.

19. The holster belt of claim 18, further comprising a third pocket and a fourth pocket integrally formed in the belt portion on either side of the first and second pocket away from the holster engagement strip.

20. The holster belt of claim 18, wherein the holster engagement strip further comprises:

an inner layer comprising a nylon belt webbing material; and an outer layer comprising a nylon belt webbing material, wherein the inner layer and outer layer of the holster engagement strip in the holster mounting portion are secured to one another.

* * * * *